US011454419B2

(12) United States Patent
Wojcik

(10) Patent No.: US 11,454,419 B2
(45) Date of Patent: Sep. 27, 2022

(54) COSMETIC EQUIPMENT SHIELD

(71) Applicant: Ross Wojcik, Austin, TX (US)

(72) Inventor: Ross Wojcik, Austin, TX (US)

( * ) Notice: Subject to any disclaimer, the term of this patent is extended or adjusted under 35 U.S.C. 154(b) by 231 days.

(21) Appl. No.: 16/871,900

(22) Filed: May 11, 2020

(65) Prior Publication Data

US 2020/0370783 A1 Nov. 26, 2020

Related U.S. Application Data

(60) Provisional application No. 62/851,195, filed on May 22, 2019.

(51) Int. Cl.

| | |
|---|---|
| ***F24F 13/20*** | (2006.01) |
| ***E04B 2/76*** | (2006.01) |
| ***F24F 13/15*** | (2006.01) |
| ***E04D 13/00*** | (2006.01) |
| ***E04B 2/74*** | (2006.01) |

(52) U.S. Cl.

CPC ..... *F24F 13/20* (2013.01); *E04B 2/7409* (2013.01); *E04B 2/7435* (2013.01); *E04B 2/76* (2013.01); *E04D 13/00* (2013.01); *F24F 13/15* (2013.01); *F24F 2221/16* (2013.01); *F24F 2221/26* (2013.01)

(58) Field of Classification Search

CPC ..... F24F 13/20; F24F 13/15; F24F 2221/16; F24F 2221/26; E04B 2/7409; E04B 2/7435; E04B 2/76; E04D 13/00

See application file for complete search history.

(56) References Cited

U.S. PATENT DOCUMENTS

| | | | | |
|---|---|---|---|---|
| 3,170,587 A | | 2/1965 | Beeber | |
| 3,242,686 A | | 3/1966 | Bowman et al. | |
| 3,702,211 A | * | 11/1972 | Young et al. | F24F 13/20 312/265.4 |
| 4,068,427 A | * | 1/1978 | Camardo | E04G 21/26 52/749.1 |
| 5,129,239 A | | 7/1992 | Thurman | |
| 5,664,384 A | | 9/1997 | Cullinan | |
| 5,832,674 A | * | 11/1998 | Ledbetter | F24F 13/24 52/27 |
| 6,138,993 A | * | 10/2000 | Mitchell, Jr. | E04H 17/163 256/25 |
| 6,782,668 B2 | * | 8/2004 | Bruce | G09F 19/22 52/127.2 |

(Continued)

*Primary Examiner* — Phi D A

(74) *Attorney, Agent, or Firm* — Kirk A. Buhler; Buhler & Associates

(57) ABSTRACT

Improvements in a cosmetic equipment shield that provides a cosmetic shield that can cover all of the equipment that can exist on the roof of a building is disclosed. The cosmetic shield convers the roof equipment on one or more sides to improve the visual appearance of the building. The shield allows air movement through the cosmetic shield. The metal strips are staggered, offset or otherwise configured so they prevent viewing through the metal strips or louvers, but allows air flow. The cosmetic equipment shield is secured to the roof to resist most weather conditions from rain to wind, hot temperatures and freezing temperatures. The cosmetic equipment shield is configured for nearly infinite straight walls and can also include angle brackets to change the direction of the shield to 90 degrees or 270 degrees or can be angled slightly in a curved appearance.

20 Claims, 6 Drawing Sheets

(56) References Cited

U.S. PATENT DOCUMENTS

| | | | | |
|---|---|---|---|---|
| 6,807,782 | B2 | 10/2004 | Forman et al. | |
| 7,059,088 | B2 * | 6/2006 | Lattanzio | F24F 13/20 256/25 |
| 7,819,151 | B1 | 10/2010 | Kuhn | |
| 8,505,182 | B2 | 8/2013 | Kuhn | |
| 9,291,356 | B2 * | 3/2016 | Demster | F24F 1/022 |
| 11,203,867 | B2 * | 12/2021 | Ferland | F24F 13/20 |
| 2006/0165931 | A1 | 7/2006 | Gaulrapp et al. | |
| 2009/0019789 | A1 * | 1/2009 | Gephart | F24F 13/20 256/25 |

* cited by examiner

COSMETIC EQUIPMENT SHIELD

CROSS REFERENCE TO RELATED APPLICATIONS

This application claims the benefit of Provisional Application Ser. No. 62/851,195 filed May 22, 2019 the entire contents of which is hereby expressly incorporated by reference herein.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

Field of the Invention

This invention relates to improvements in a configurable structural shield that surrounds equipment. More particularly, the present cosmetic equipment shield allows for erecting an ornamental structure around roof or ground mounted equipment to improve the cosmetic appearance of a building.

Description of Related Art including information disclosed under 37 CFR 1.97 and 1.98

When buildings are constructed the roof of the building typically includes heating ventilation and air conditioning equipment and can also include a variety of vents, electrical and plumbing equipment. This equipment often sits above the building where it can be ugly and can detract from the visual appearance of the building. Sometimes a wall is built around the equipment to reduce the appearance from the ground, but when the equipment is replaced the existing wall does not fit. A standard wall can also restrict air movement and reduce the efficiency of the equipment. Another problem is with walls that do not match the color of a building or a miss-match of wall construction and heights.

A number of patents and or publications have been made to address these issues. Exemplary examples of patents and or publication that try to address this/these problem(s) are identified and discussed below.

U.S. Pat. No. 7,059,088 issued on Jun. 13, 2016 to Lattanzio; Maurice and is titled Apparatus for Screening. This patent discloses a method and apparatus for screening faces of a substantially rectangular equipment. The apparatus having a frame structure including a plurality of screen support frames disposed around the equipment, each face having edge screen support frames laterally spaced horizontally between two vertical edges of each face such that a corner of the equipment includes edge screen support frames disposed in perpendicular relationship secured thereto, a plurality of movable screen cover panels and stationary screen cover panels supported within the screen support frame, the movable screen cover panels being slidably moved to substantially overlap the stationary cover panels to substantially expose the faces of the equipment. While the screen covers the sides of the equipment it mounts completely to the equipment for support.

U.S. Publication Number 2009/0019789 was published on Jan. 22, 2009 to Richard Douglas Gephart et al., and is titled Curb-Mounted Screen for Rooftop Equipment. This publication discloses a curb-mounted screen for roof-top equipment has wall structure spaced outwardly from the curb for concealing the equipment from view. Fasteners secured to generally horizontally extending support members are hooked over the curb to secure the screen thereto without attaching the screen to the underlying roof or the equipment thereon. This cover mounts to the curb of the equipment for support and is not free standing.

U.S. Pat. Nos. 7,819,151 and 8,505,182 that issued on Oct. 26, 2010 and Aug. 13, 2013, respectively, to James J. Kuhn are titled Utility Equipment Cover. These patents disclose a cover for concealing utility equipment on real property such as air conditioner condenser units, telephone and electric cabinets, and trash containers, has a modular, rigid and stiff skeletal frame and a shell of flexible openwork material. Lengths and angles between components of the cover and the number of components can be adjusted such that a single cover kit is alone or in combination with supplementary components adaptable to fit objects of different sizes and shapes. These patents do not provide a structural connection to a roof to prevent damage in high wind areas.

What is needed is a configurable wall that mounts onto an existing building to provide a cohesive appearance, sufficient air flow and strength to resist weather. The proposed cosmetic equipment shield disclosed in this document provides the solution.

BRIEF SUMMARY OF THE INVENTION

It is an object of the cosmetic equipment shield to provide a cosmetic shield that can cover all of the equipment that exists on the roof of a building. The cosmetic shield can be fabricated in standard lengths to be easily erected to provide a continuous shield that convers the roof equipment on one, two, three or all 4 sides to improve the visual appearance of the building. The cosmetic shield can be fabricated in standard heights or can be stacked together to make taller heights. The cosmetic shield is supported on and with roof mount brackets and arms that secure into an existing roof.

It is an object of the cosmetic equipment shield to provide air movement through the cosmetic shield. The cosmetic shield is constructed from and or a plurality of offset and or bent metal strips or louvers. The metal strips are staggered, offset or otherwise configured so they prevent viewing through the metal strips, but also to allow air to pass through the cosmetic shield. This allows any air that is needed by the equipment to pass through the cosmetic shield to cool the equipment and provides limit restriction to the flow of air. Air flow can be directed based upon a prevailing wind and can also be based upon optimal air flow out of the equipment that is being surrounded.

It is another object of the cosmetic equipment shield to be secured to the roof to resist most weather conditions from rain to wind, hot temperatures and freezing temperatures. The cosmetic shield mounts to the structure of the roof and uses support arms from the top of the cosmetic shield to the structure of the roof at location inside of the cosmetic shield to further prevent visual obstruction of the cosmetic shield from a viewing standpoint outside of the cosmetic shield.

It is still another object of the cosmetic equipment shield to be configured and configurable for a nearly infinite straight side and can also include angle brackets to change the direction of the shield to 90 degrees or 270 degrees from the plane of the shield. This allows the shield to be erected continuously around the equipment as a single integrated structure for cosmetic appearance as well as the angles thereby improving the structural rigidity of the equipment shield. While angle changes of 90 and 270 degrees are identified, other angles of direction change can be made as well as a rounded arc sector or circle.

Various objects, features, aspects, and advantages of the present invention will become more apparent from the following detailed description of preferred embodiments of the invention, along with the accompanying drawings in which like numerals represent like components.

BRIEF DESCRIPTION OF THE SEVERAL VIEWS OF THE DRAWING(S)

DETAILED DESCRIPTION OF THE INVENTION

Figure 1:
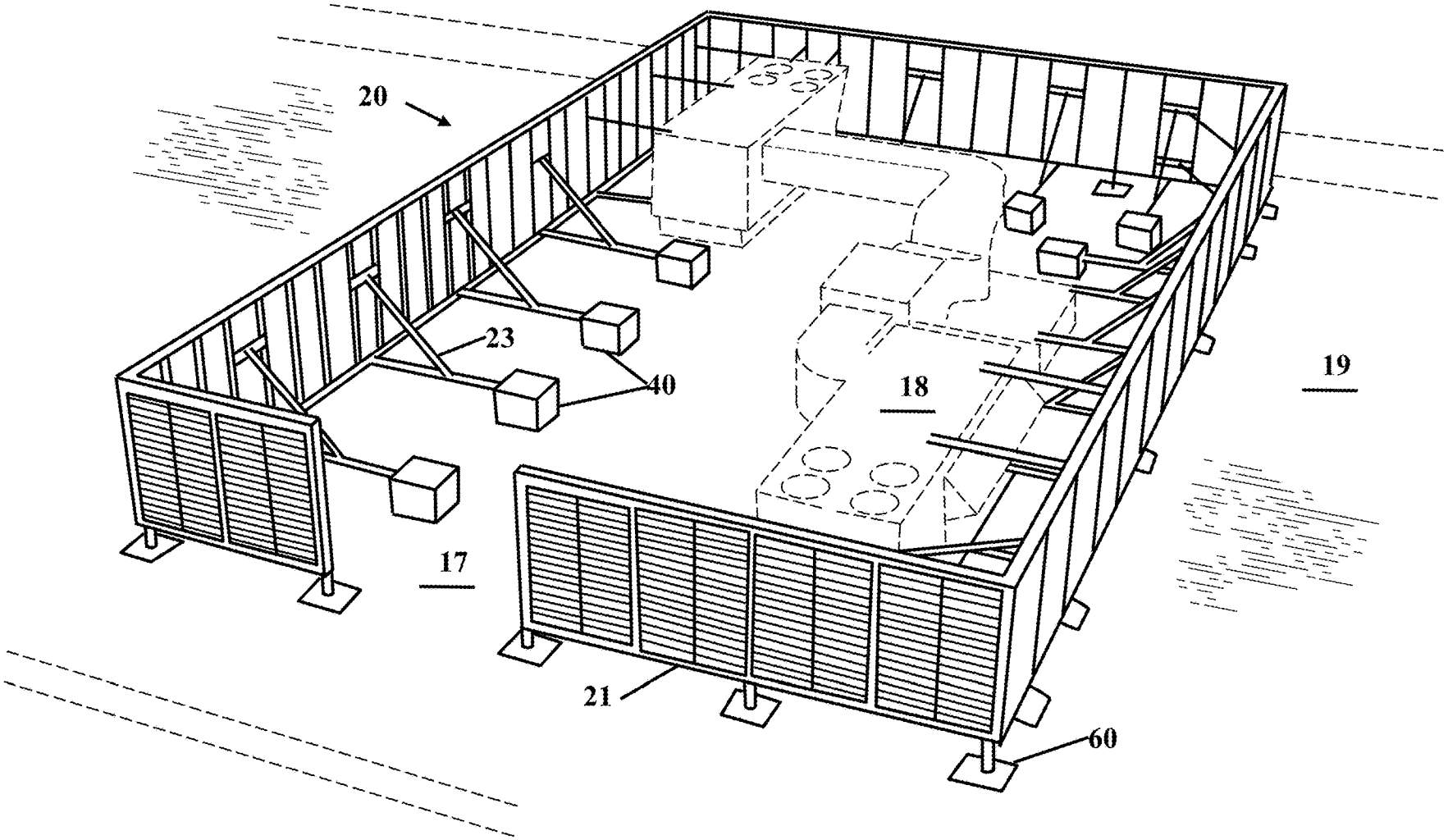
FIG. 1 shows a perspective view of the cosmetic equipment screen shield on a roof surrounding a majority of the roof equipment.

It will be readily understood that the components of the present invention, as generally described and illustrated in the drawings herein, could be arranged and designed in a wide variety of different configurations. Thus, the following more detailed description of the embodiments of the system and method of the present invention, as represented in the drawings, is not intended to limit the scope of the invention, but is merely representative of various embodiments of the invention. The illustrated embodiments of the invention will be best understood by reference to the drawings, wherein like parts are designated by like numerals throughout.

ITEM NUMBERS AND DESCRIPTION

| | |
|---|---|
| 17 | opening |
| 18 | equipment |
| 19 | roof |
| 20 | equipment screen |
| 21 | track(s) |
| 22 | panel frame |
| 23 | telescoping support |
| 25 | holes |
| 27 | enclosed bracket |
| 28 | corner clip |
| 40 | ballasted stabilizer |
| 50 | inside bracket |

-continued

| | |
|---|---|
| 51 | arm |
| 52 | angle bracket |
| 53 | hole(s) |
| 54 | angle bracket |
| 55 | "U" tube |
| 56 | "U" tube |
| 57 | "L" bracket |
| 58 | "U" tube |
| 60 | rooftop support base |
| 65 | angle bracket |
| 66 | angle bracket |
| 70 | panel |
| 71 | sight proof louver |
| 72 | 53% open air louver |
| 73 | 38% open air louver |
| 74 | sound block louver |
| 75 | sound insulation |
| 76 | louver |
| 77 | louver |
| 78 | louver |
| 79 | louver |
| 80 | R-panel |
| 81 | U-Panel |
| 82 | corrugated panel |

FIG. 1 shows a perspective view of the cosmetic equipment screen 20 shield on a roof 19 surrounding a majority of the roof equipment 18. This figure shows a specific embodiment that is configured for the roof equipment 18 shown. The roof equipment is two air conditioning units that are connected with ducting. The circular areas of the equipment are fans that draw air from the sides of the air conditioning units and blow the air vertically. It should be understood from this description that there must be some air that passes under or through the equipment screen 20 to provide proper operation of the roof equipment 18.

The equipment screen 20 is shown wrapping around the majority of the roof equipment 18 and has an opening 17 for maintenance or workers to easily access the roof equipment without the need of a ladder. It is also contemplated that the equipment screen 20 can be configured with a door or access to the area within the equipment shield 20. The equipment screen 20 is shown both connected or secured to the roof equipment with telescoping supports 23 and also with ballasting stabilizer 40 and on rooftop support bases 60 that are disclosed in design patent D883,775. The equipment screen 20 provides protection of the roof equipment 18 and conceals the roof equipment 18 as viewed from a horizon or from below, such as from the ground. The equipment screen 20 is made from one or a plurality of panels that can be configured and built on-site to accommodate a particular configuration of roof equipment 18 using standard sized screen components on telescoping supports 23 that are captured on exterior tracks 21 to hold and support the panels in a desired location that can withstand environmental conditions of wind, rain and sun. The equipment screen 20 shield are configured for nearly infinite straight wall and can also include angle brackets to change the direction of the shield to 90 degrees or 270 degrees or can be formed for a curved appearance.

Figure 2:
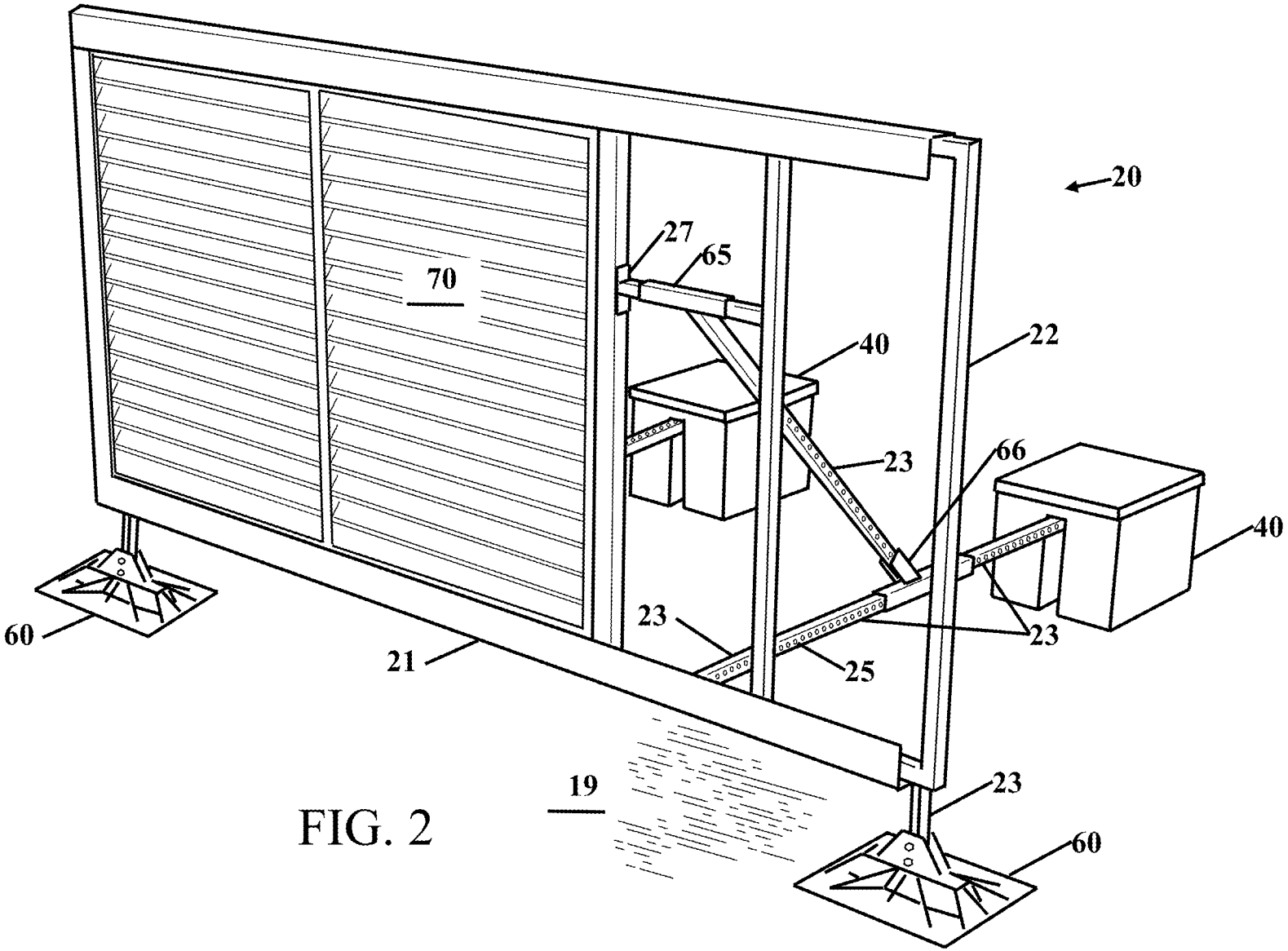
FIG. 2 shows a section of the cosmetic equipment shield.

FIG. 2 shows a section of the cosmetic equipment shield 20. The equipment shield 20 is configurable in a variety of ways to accommodate the installation. In this figure, the equipment shield 20 is configured as a free-standing screen that relies upon ballast stabilizers and rooftop support bases 60. The rooftop support base(s) 60 are disclosed in design patent D883,775 and are configurable in a number of arrangements with supports or telescoping supports 23 that are secured vertically, horizontally or at an angle on the rooftop support bases 60. While the height of the equipment shield 20 can be adjusted by the fabrication height of the panel 70, the length of the supports on the rooftop support base 60 can also be adjusted raise to panel 70. The panels 70 can be slid into variable width tracks for easy installation and removal. Raising the panel(s) 70 provides unrestricted air flow under the panel(s) 70 without allowing a view of the enclosed equipment except at an elevated location or at extended distances from the building. The rooftop support base 60 can be screwed, bonded or can simply rest on the roof 19.

The ballasted stabilizers 40 are usually all placed within the perimeter of the panel(s) 70 but can also be placed on the outside of the panel(s) 70 if the cosmetic appearance is not important. The ballasted stabilizers 40 can be screwed, bonded or can simply rest on the roof 19. The ballasted stabilizers 40 are shown with telescoping supports 23 extending horizontally from the ballasted stabilizers 40 and with angle brackets 65 and 66 on telescoping supports 23 to secure the panel(s) 70 and maintain the panel(s) 70 at a desired vertical orientation. While a vertical orientation of the panel(s) 70 is shown, it is contemplated that the panel(s) 70 can be placed at an angle as desired by altering the length of the telescoping support 23.

[Para 52] The quantity and location of the ballasted stabilizers 40 are selected based upon the size of the equipment screen and the expected maximum environmental conditions and building code. The ends of angle bracket 65 has enclosing bracket(s) 27 that are secured to the panel frame tubular member(s) 22. The telescoping supports 33 have a plurality of holes 25 that make adjustment and location simple with the panel(s) 70 are being erected.

Figure 3:
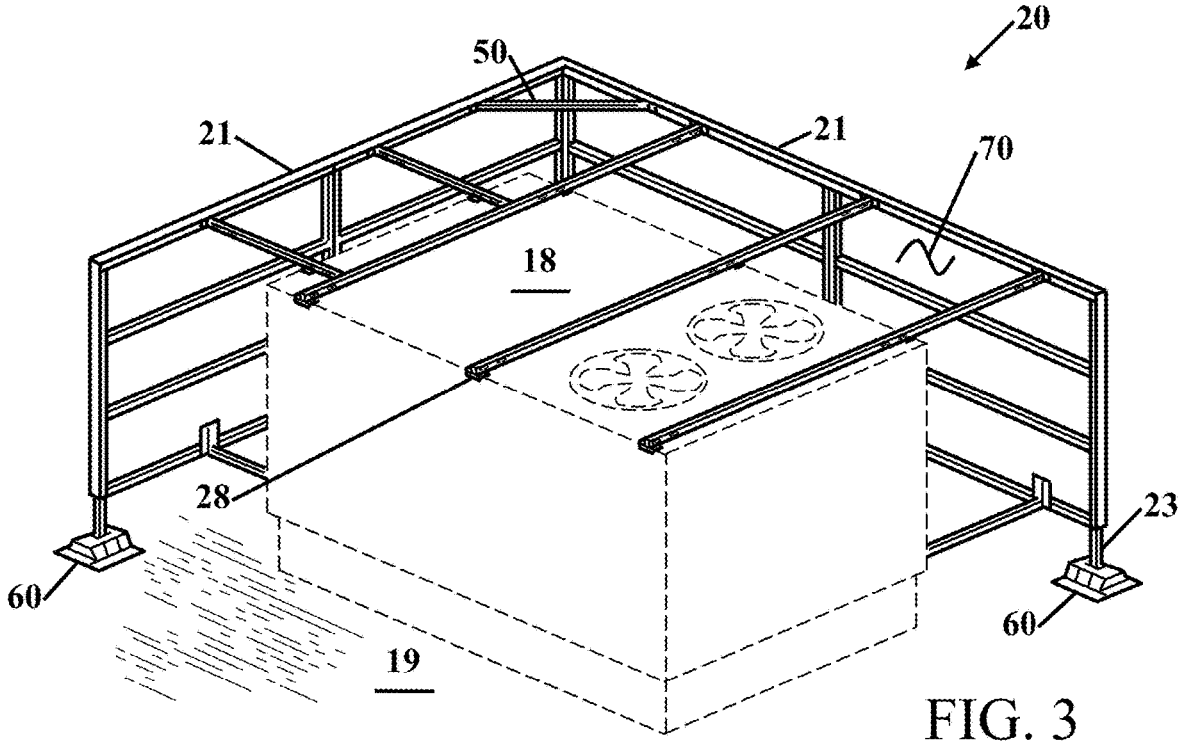
FIG. 3 shows a perspective view of the cosmetic equipment shield around two sides of an air conditioning unit.
Figure 4:
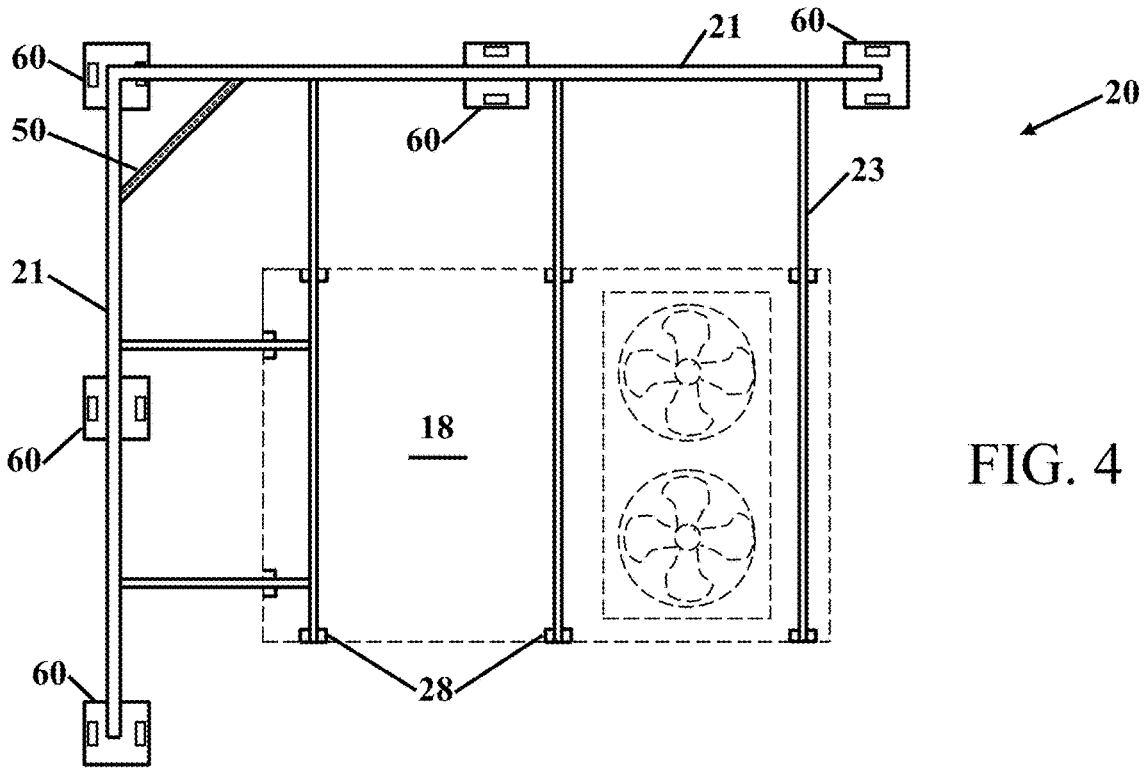
FIG. 4 shows a top view of the cosmetic equipment shield on the air conditioning unit.

FIG. 3 shows a perspective view of the cosmetic equipment shield 20 around two sides of an air conditioning unit and FIG. 4 shows a top view of the cosmetic equipment shield on the air conditioning unit 18. In this figure the equipment shield 20 is both secured to the roof mounted equipment and also to the roof 19. The equipment shield 20 is secured to the air conditioning unit 18 with telescoping supports 23 and with corner clips 28 that wrap around the top and a side of the air conditioning unit 18. Screws or other fasteners hold the telescoping supports 23 to the air conditioning unit 18.

One or multiple support feet 60 elevate the panel(s) 70 above the roof 17 to allow for some air movement under the equipment shield 20. A set of tracks 21 surround the panel(s) to provide structural support and a thicker surface for retaining threaded fasteners or the like. Cushioning pads can be used between the air conditioning unit 18 and the telescoping supports 23 to prevent vibration. When the equipment shield 20 is assembled to makes a 90 degree bend, a corner arm 50 is used to brace the joined shield panels 70.

Figure 5:
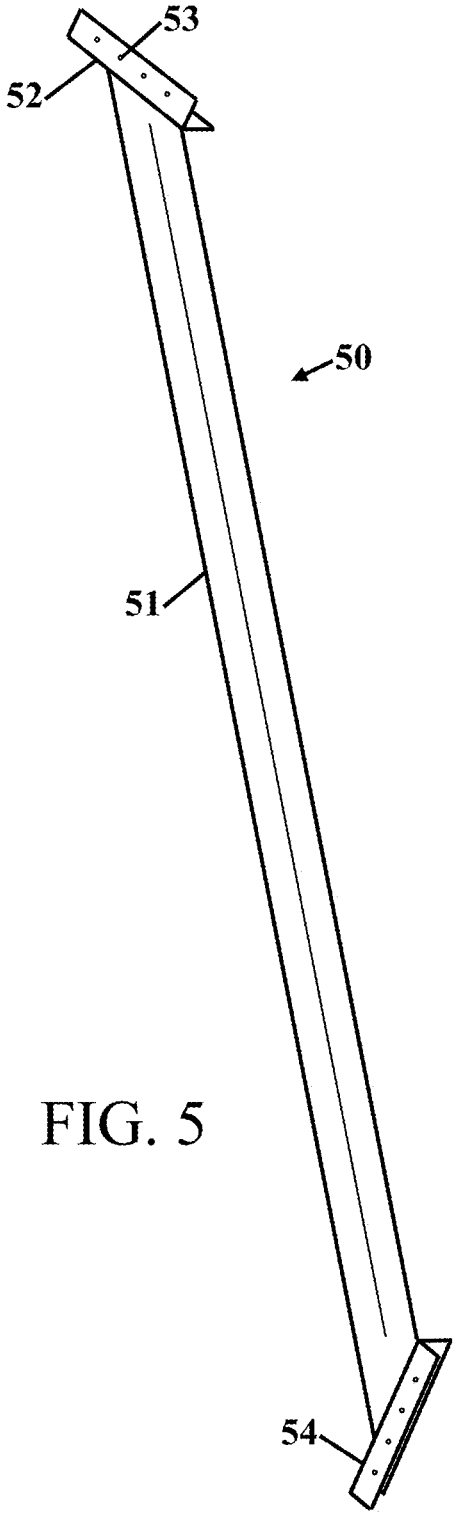
FIG. 5 shows a corner arm.

FIG. 5 shows a corner arm 50. The corner arm 50 can be used for both joining panels 70 and for supporting panels 70 with adjustable telescoping members to the roof. The inside bracket 50 is constructed with an arm 51 that has a first angle bracket 52 on one end and a second angle bracket 54 at a second distal end if the arm 51. There is a plurality of holes 53 in each of the angle brackets 53 and 54 for securing the corner arm 50 to equipment, braces and telescoping supports to secure the panels at the desired location/position.

Figure 6:
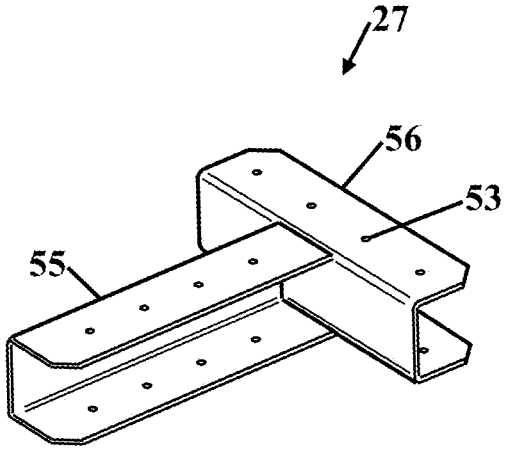
FIG. 6 shows a frame bracket for three sides of a frame.

FIG. 6 shows a frame bracket for three sides of a frame 27. This frame 27 member has two "U" tubes 55 and 56 that are joined in a perpendicular relationship. The "U" shape allows the brackets to wrap around three sides of the tracks 21 that retain the panels. There are multiple holes 53 in the brackets that allow the brackets to be secured to the tracks.

Figure 7:
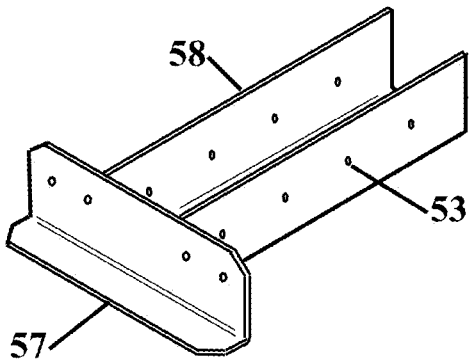
FIG. 7 shows a frame bracket for an outer side that hold two sides of a frame.

FIG. 7 shows a frame bracket for an outer side that hold two sides of a frame. This frame member has a "U" tube 58 and an "L" bracket that are joined in a perpendicular relationship. The "U" shape allows the brackets to wrap around three sides of the tracks 21, while the "L" bracket 57 can be secured to an end, top or side of the track(s) 21. There are multiple holes 53 in the brackets that allow the brackets to be secured to the tracks.

Figure 8A:
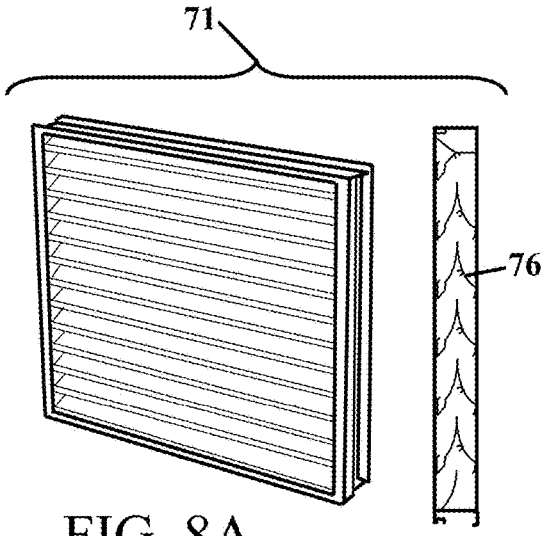
FIG. 8A-8D show different contemplated louver panels.

FIG. 8A-8D show different contemplated louver panels. These open-air louvers allow for the mechanical equipment to operate properly while being protected from damage and vandalism. The panel and cross-section of the panel shown in FIG. 8A shows a sight-proof louver with a 21% open air path for air movement through the louver 71. Within the frame are bent louvers 76 in an inverted "V" shape that are retained within the frame. This louver 71 provides a hybrid that provides both bocks vision of equipment on the other side of the louver and allows air flow through the louver 71.

Figure 8B:
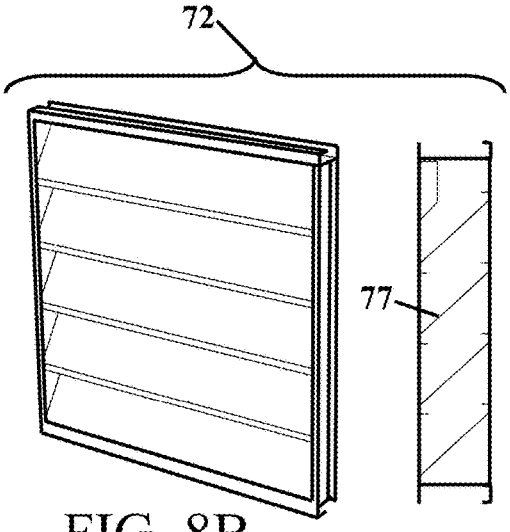

The panel and cross-section of the panel shown in FIG. 8B shows a louver that is 53% open to provide greater air flow through the louvers 77 with some sight through the louvers 77 at some angles.

Figure 8C:
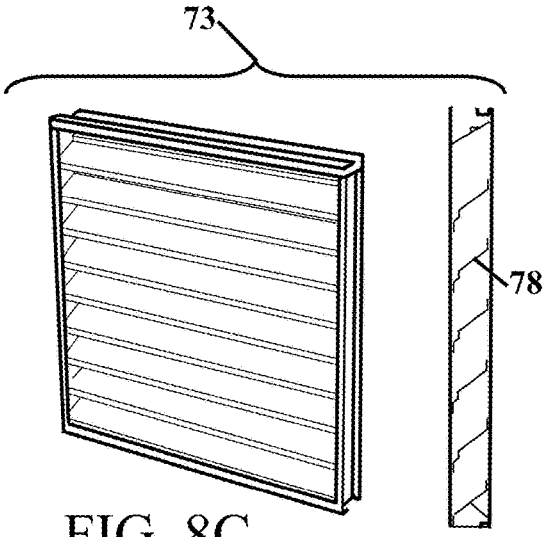

The panel and cross-section of the panel shown in FIG. 8C shows a louver with shorter spacing that is 38% open to provide air flow through the louvers 78 with some sight through the louvers 78 at some angles.

Figure 8D:
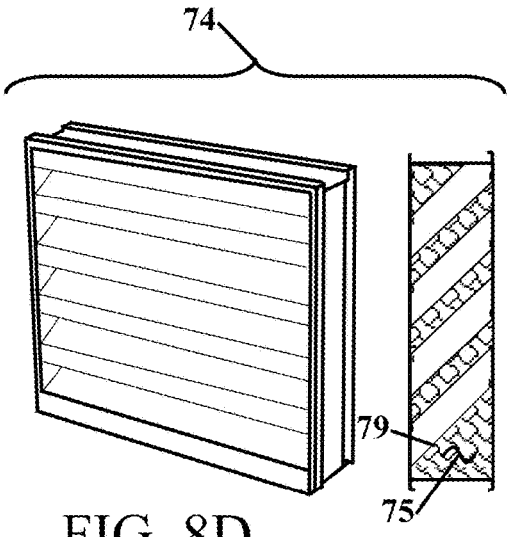

The panel and cross-section of the panel shown in FIG. 8D shows a louver with sound insulation. This configuration of louver provides 38% open air movement in addition to the sound blocking placed between the louvers 79. The sound insulation 75 reduces the sound generated by the equipment within the erected panels. Sound absorbing panels are designed for building code sound requirements and meet noise requirements at the equipment or at the property line. Sound reduction can reduce sound levels up to 12 bB at street level.

While a finite number of louvers with a particular shape is shown in these figures, it should be understood that the shape of the frame and louvers within the frame and the number of louvers can be more or less than the number shown in the figures.

Figure 9C:
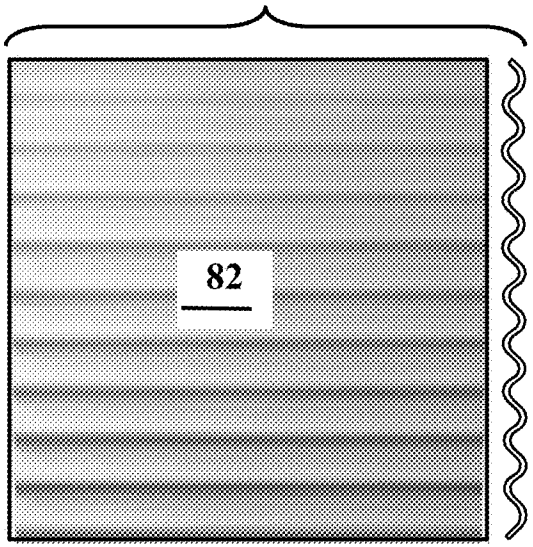
FIG. 9A-9C show different contemplated panel patterns.
Figure 9B:
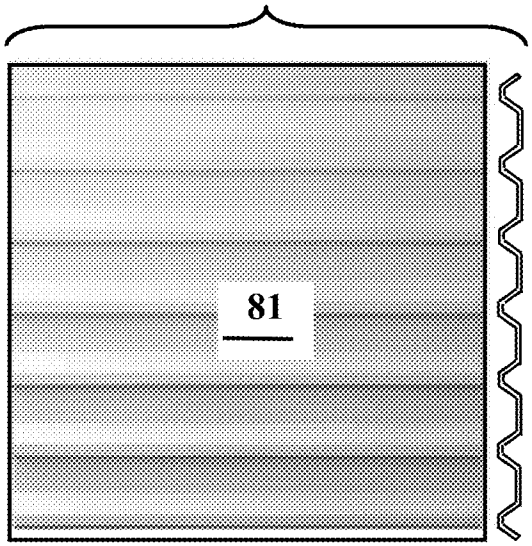
Figure 9A:
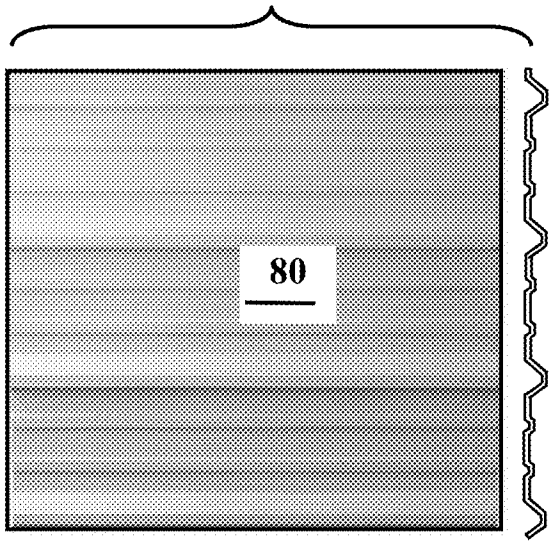

FIG. 9A-9C show different contemplated panel patterns. The solid metal panels can be made in a range of colors. The panels can be aligned horizontally or vertically to match the visual lines of a building. FIG. 9A shows an R-panel 80, FIG. 9B shows a U-Panel 81 and FIG. 9C shows a corrugated panel 82.

Thus, specific embodiments of a cosmetic equipment shield have been disclosed. It should be apparent, however, to those skilled in the art that many more modifications besides those described are possible without departing from the inventive concepts herein. The inventive subject matter, therefore, is not to be restricted except in the spirit of the appended claims.

The invention claimed is:

1. A cosmetic equipment shield comprising:

at least three structural rooftop support bases directly under at least two vertical cosmetic panels that are configured to support and distribute a weight of said at least two vertical cosmetic panels;

said at least three structural support bases are secured into an existing roof;

said at least two vertical cosmetic panels being supported within a tubular member frame;

an angle bracket being connected to two enclosed brackets that are secured to said tubular member frame within said tubular member frame;

at least two support arms that extend from said angle bracket to at least two ballast stabilizers mounted to said existing roof;

at least one vertical cosmetic panel includes a plurality of louvers whereby air can pass between in combination with said plurality of vertical vanes and prevent viewing through said plurality of louvers, and an inside bracket joiner that allows for joining a first of said at least two vertical cosmetic panels at a 90-degree angle to a second of said at least two vertical cosmetic panels.

2. The cosmetic equipment shield according to claim 1, wherein said at least two vertical cosmetic panels has an open air path of between 21% and 53%.

3. The cosmetic equipment shield according to claim 1, wherein said plurality of louvers are angled or bent.

4. The cosmetic equipment shield according to claim 1, wherein one of said at least three structural roof support bases is directly under a connection of said first of said at least two vertical cosmetic panels and said second of said at least two vertical cosmetic panels.

5. The cosmetic equipment shield according to claim 1, wherein said at least one of said two vertical cosmetic panels is made from a group of materials consisting of aluminum or steel.

6. The cosmetic equipment shield according to claim 1, wherein said at least one of said at least two support arms is a telescoping support.

7. The cosmetic equipment shield according to claim 6, wherein said telescoping support is adjusts a height of said at least one vertical cosmetic panel above said existing roof.

8. The cosmetic equipment shield according to claim 1, wherein said at least two ballasted stabilizers are securable to said existing roof.

9. The cosmetic equipment shield according to claim 8, wherein said at least two ballasted stabilizers includes a horizontal telescoping support that connects between at least one of said ballasted stabilizers and at least one of said at least two vertical cosmetic panel.

10. The cosmetic equipment shield according to claim 9, wherein said horizontal telescoping support connected to said angle bracket.

11. The cosmetic equipment shield according to claim 1, wherein said least three structural rooftop support bases are configured to connect to a telescoping support that connects to an exterior track of said tubular member frame.

12. The cosmetic equipment shield according to claim 1, further includes a corner clip that is configured to secure said at least two support arms on existing equipment on said existing roof.

13. The cosmetic equipment shield according to claim 12, includes at least three vertical cosmetic panels that surround at least three sides of said existing equipment.

14. The cosmetic equipment shield according to claim 12, includes at least four vertical cosmetic panels that surround at least a portion of four sides of said existing equipment.

15. The cosmetic equipment shield according to claim 1, wherein at least one of said at least two vertical cosmetic panels is a solid metal panel.

16. The cosmetic equipment shield according to claim 1, wherein said at least one of said two vertical cosmetic panel is includes sound absorbing insulation.

17. The cosmetic equipment shield according to claim 1, wherein said inside bracket joiner connects from a horizontal tube of said tubular member frame of said first of said at least two vertical cosmetic panels to a second horizontal tube of said tubular member frame of said second of said at least two vertical cosmetic panels.

18. The cosmetic equipment shield according to claim 1, wherein said inside bracket includes an arm with a first angle bracket at one end of said arm and a second angle bracket at an opposite end of said arm.

19. The cosmetic equipment shield according to claim 11, wherein each of said three structural rooftop support bases support said tubular support and allow for a vertically, a horizontally and at an angular connection.

20. The cosmetic equipment shield according to claim 11, wherein said telescoping support allows for vertical positioning of said exterior track.

* * * * *